US010556434B2

(12) United States Patent
Maeshima et al.

(10) Patent No.: US 10,556,434 B2
(45) Date of Patent: Feb. 11, 2020

(54) INKJET RECORDING APPARATUS

(71) Applicant: KYOCERA Document Solutions Inc., Osaka-shi, Osaka (JP)

(72) Inventors: Masanobu Maeshima, Osaka (JP); Noriaki Furukawa, Osaka (JP); Takashi Somete, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 16/141,850

(22) Filed: Sep. 25, 2018

(65) Prior Publication Data

US 2019/0092024 A1 Mar. 28, 2019

(30) Foreign Application Priority Data

Sep. 27, 2017 (JP) ..... 2017-186177

(51) Int. Cl.
*B41J 2/165* (2006.01)

(52) U.S. Cl.
CPC ..... *B41J 2/16552* (2013.01); *B41J 2/16508* (2013.01); *B41J 2/16511* (2013.01); *B41J 2/16538* (2013.01); *B41J 2/16544* (2013.01); *B41J 2/16585* (2013.01); *B41J 2002/1657* (2013.01); *B41J 2002/16591* (2013.01)

(58) Field of Classification Search
CPC ..... B41J 2/16552; B41J 2/16508; B41J 2/16511; B41J 2/16538
See application file for complete search history.

(56) References Cited

U.S. PATENT DOCUMENTS

2006/0066663 A1* 3/2006 Takagi ..... B41J 2/16535 347/33
2009/0303279 A1* 12/2009 Roh ..... B41J 2/16552 347/28
2016/0114587 A1* 4/2016 Furukawa ..... B41J 2/16535 347/33

FOREIGN PATENT DOCUMENTS

JP 2007083496 A 4/2007

* cited by examiner

*Primary Examiner* — Jason S Uhlenhake
(74) *Attorney, Agent, or Firm* — Alleman Hall Creasman & Tuttle LLP

(57) ABSTRACT

An inkjet recording apparatus includes an ink ejection surface, a washing liquid storage portion, a washing liquid nozzle, a mesh sheet, and a sponge member. The washing liquid storage portion includes a supply surface adjacent to the ink ejection surface. The washing liquid nozzle includes a communicating hole that is communicated from a supply port formed in the supply surface to an inside of the washing liquid storage portion, and forms a concave meniscus by a surface of the washing liquid in the communicating hole. The mesh sheet is provided in close contact with an opposite rear surface of the supply surface, and has an opening that is smaller in size than an inner diameter of the communicating hole. The sponge member is provided in a compressed state in the inside of the washing liquid storage portion, presses the mesh sheet toward the opposite rear surface of the supply surface.

4 Claims, 14 Drawing Sheets

INKJET RECORDING APPARATUS

INCORPORATION BY REFERENCE

This application is based upon and claims the benefit of priority from the corresponding Japanese Patent Application No. 2017-186177 filed on Sep. 27, 2017, the entire contents of which are incorporated herein by reference.

BACKGROUND

The present disclosure relates to an inkjet recording apparatus configured to record an image on a recording medium by ejecting ink from a recording head onto the recording medium, and specifically, relates to an inkjet recording apparatus configured to wash an ink ejection surface of the recording head.

In general, there is known an inkjet recording apparatus configured to record an image on a recording medium such as a paper sheet by ejecting ink from a nozzle of a recording head onto the recording medium. In the inkjet recording apparatus, when an ink drop is ejected from the nozzle, ink scattered around the nozzle or ink that had overflowed from the nozzle may adhere to an ink ejection surface. In that case, an ink ejection direction may be shifted from a target direction due to the ink that has adhered to the periphery of the nozzle, or an amount of ink that is different from a target amount of ink may be ejected, thereby causing an image recording failure.

On the other hand, there is known an inkjet recording apparatus configured to wipe an ink ejection surface of a recording head so as to wash away ink that has adhered to a periphery of a nozzle. In addition, there is also known an inkjet recording apparatus configured to wipe an ink ejection surface by supplying washing liquid to the ink ejection surface from a plurality of washing liquid supply ports provided in the ink ejection surface.

SUMMARY

An inkjet recording apparatus according to an aspect of the present disclosure includes an ink ejection surface, a washing liquid storage portion, a washing liquid nozzle, a metal-made mesh sheet, and a sponge member. The ink ejection surface includes an ink ejection port from which ink is ejected. The washing liquid storage portion includes a supply surface adjacent to the ink ejection surface, and stores washing liquid used for washing the ink ejection surface. The washing liquid nozzle includes a communicating hole that is communicated from a supply port formed in the supply surface of the washing liquid storage portion to an inside of the washing liquid storage portion, and forms a concave meniscus by a surface of the washing liquid in the communicating hole. The mesh sheet is provided in close contact with an opposite rear surface of the supply surface of the washing liquid storage portion, and has an opening that is smaller in size than an inner diameter of the communicating hole. The sponge member is provided in a compressed state in the inside of the washing liquid storage portion, and absorbs and holds the washing liquid and presses the mesh sheet toward the opposite rear surface of the supply surface.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

Figure 1:
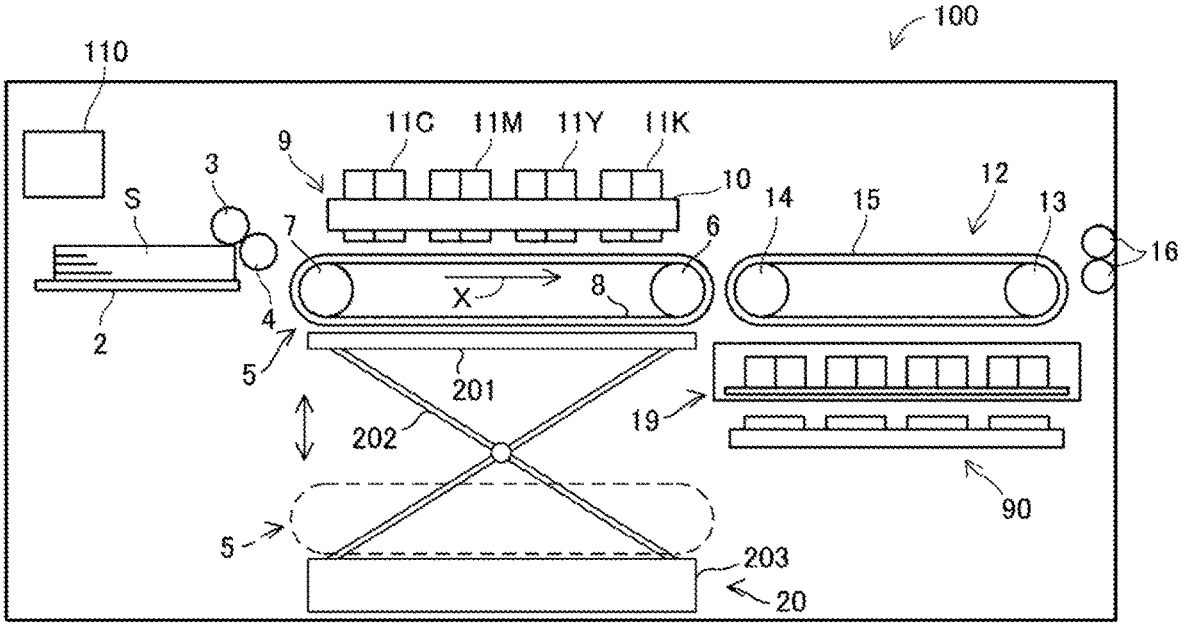
FIG. 1 is a diagram showing a structure of an inkjet recording apparatus including recording heads according to an embodiment of the present disclosure.

As shown in FIG. 1, in a left part of an inkjet recording apparatus 100 according to an embodiment of the present disclosure, a sheet feed tray 2 storing paper sheets S (recording media) is provided. At an end of the sheet feed tray 2, a sheet feed roller 3 and a driven roller 4 are provided. The sheet feed roller 3 feeds the paper sheets S stored in the sheet feed tray 2 one by one in order from a top paper sheet S. The driven roller 4 rotates following the rotation of the sheet feed roller 3.

A first conveyance unit 5 and a recording portion 9 are disposed on a downstream side of the sheet feed roller 3 and the driven roller 4 in a sheet conveyance direction X (the right side in FIG. 1). The first conveyance unit 5 includes a first drive roller 6, a first driven roller 7, and a first conveyance belt 8 that is stretched over the first drive roller 6 and the first driven roller 7. When the first drive roller 6 is rotationally driven clockwise in FIG. 1 upon receiving a control signal from a control portion 110 of the inkjet recording apparatus 100, the first conveyance unit 5 conveys, in the sheet conveyance direction X, a paper sheet S in a state of being held on the first conveyance belt 8.

The recording portion 9 includes a head frame 10 and line heads 11C, 11M, 11Y, and 11K that are held in the head frame 10. The head frame 10 is supported by a main body frame (not shown) of the inkjet recording apparatus 100. The line heads 11C, 11M, 11Y, and 11K are fixed to the head frame 10 in a state where they are aligned at predetermined intervals along the sheet conveyance direction X. In addition, the line heads 11C, 11M, 11Y, and 11K are supported at a height separated from a conveyance surface of the first conveyance belt 8 by a predetermined interval (for example, 1 mm). Each of the line heads 11C, 11M, 11Y, and 11K includes recording heads 17*a*, 17*b*, and 17*c* (see FIG. 2). Inks of four colors (cyan, magenta, yellow, and black) are respectively stored in ink tanks (not shown), and the inks are respectively supplied from the ink tanks to the recording heads 17*a*, 17*b*, and 17*c* of the line heads 11C, 11M, 11Y, and 11K of the corresponding colors via ink tubes (not shown).

Figure 2:
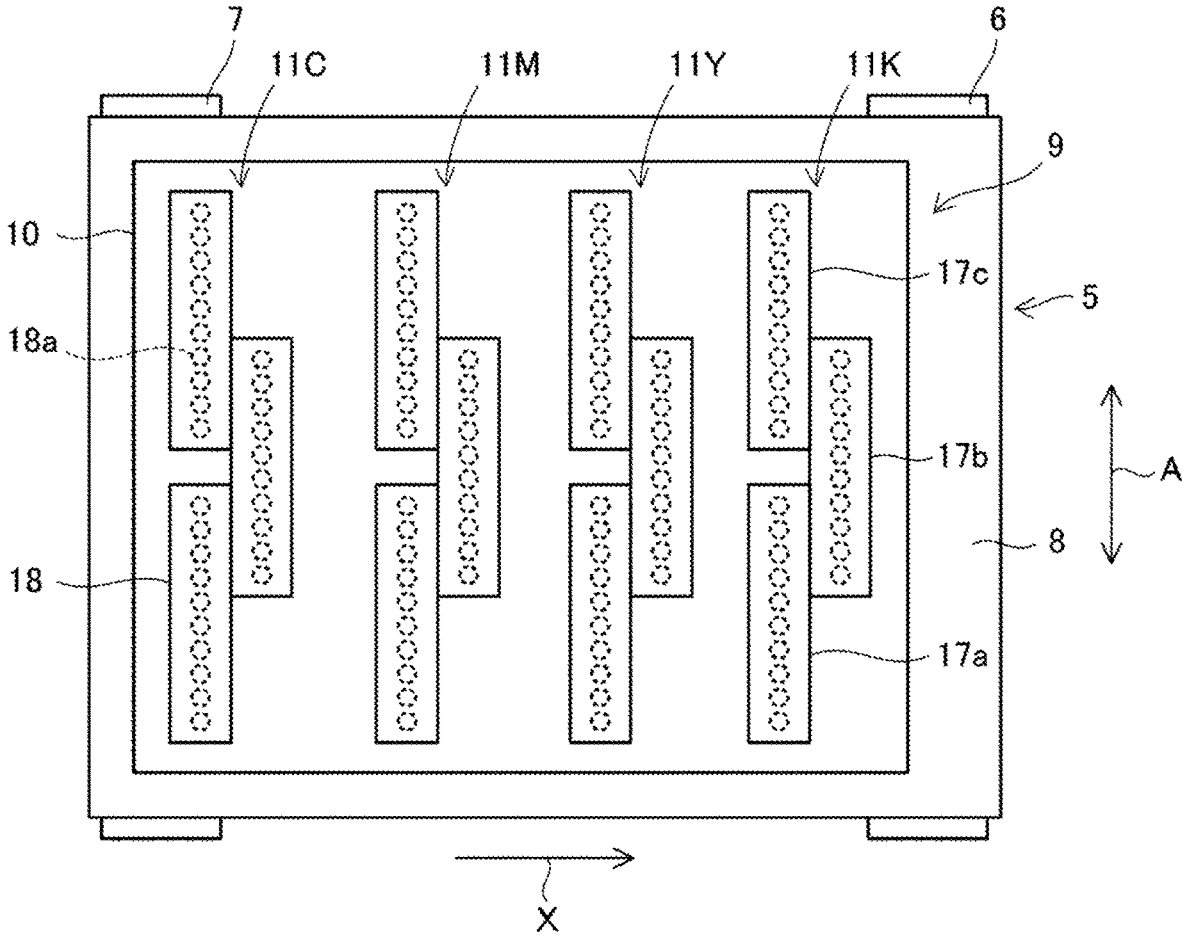
FIG. 2 is a diagram showing a first conveyance unit and a recording portion, viewed from above, of the inkjet recording apparatus shown in FIG. 1.

As shown in FIG. 2, each of the line heads 11C, 11M, 11Y, and 11K includes a plurality of (in the present embodiment, three) recording heads 17*a*, 17*b*, and 17*c*. Each of the recording heads 17*a*, 17*b*, and 17*c* includes a head portion 18. In each of the line heads 11C, 11M, 11Y, and 11K, the head portions 18 are arranged in zigzag along a sheet width direction A (an up-down direction in FIG. 2) perpendicular to the sheet conveyance direction X.

Figure 3:
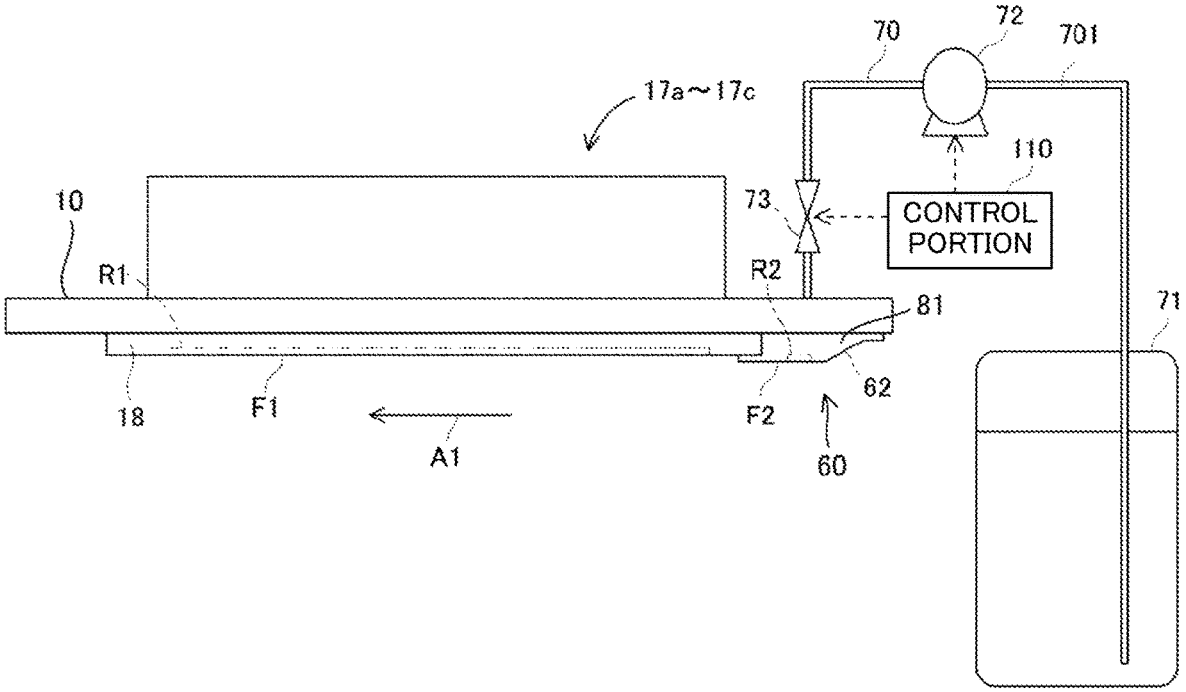
FIG. 3 is a diagram for explaining a recording head of the recording portion and a mechanism for supplying washing liquid to washing liquid supply portions of the recording portion.
Figure 4:
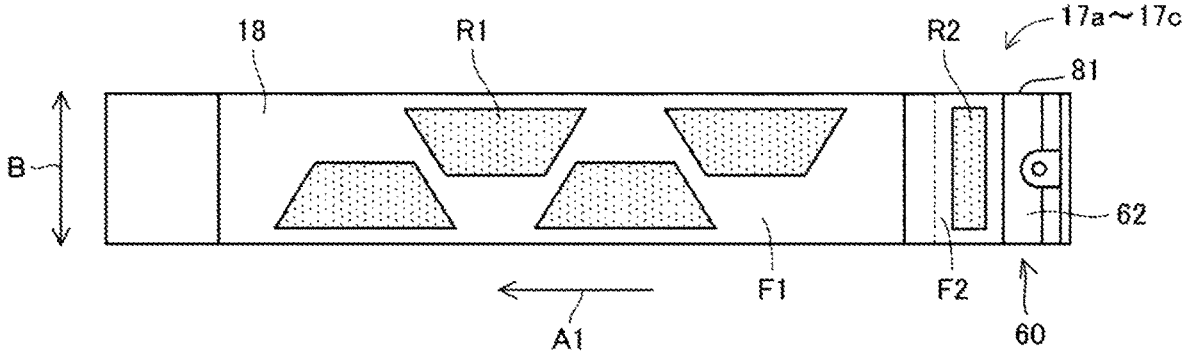
FIG. 4 is a diagram showing a recording head viewed from an ink ejection surface side.

As shown in FIG. 3 and FIG. 4, the head portion 18 includes an ink ejection surface F1 that includes an ink ejection region R1 in which a plurality of ink ejection nozzles 18*a* (see FIG. 2) are arranged. Each of the ink ejection nozzles 18*a* includes a lower opening. The lower openings are ink ejection ports from which ink is ejected onto the paper sheets S. In addition, the ink ejection surface F1 constitutes a wiping surface that is a target of wiping. It is noted that since the recording heads 17*a*, 17*b*, and 17*c* have the same shape and configuration, in FIG. 3 and FIG. 4, any one of the recording heads 17*a*, 17*b*, and 17*c* is shown as a representative thereof.

The recording heads 17*a*, 17*b*, and 17*c* eject ink from the ink ejection nozzles 18*a* in accordance with a control signal from the control portion 110 (see FIG. 1) that is output based on image data received from an external computer, toward the paper sheet S that is conveyed in a state of being sucked and held by the conveyance surface of the head portion 18. This allows inks of the four colors cyan, magenta, yellow, and black to be overlaid to form a color image on the paper sheet S on the first conveyance belt 8. It is noted that the control portion 110 controls a liquid feed pump 72 and an open/close valve 73 (see FIG. 3) that are described below. How the liquid feed pump 72 and the open/close valve 73 are controlled by the control portion 110 is described below.

In addition, each of the recording head 17*a*, 17*b*, 17*c* includes a washing liquid supply portion 60 configured to supply washing liquid 23 (see FIG. 10) that is used for wiping the ink ejection region R1. The washing liquid supply portion 60 is disposed on the upstream side (the right side in FIG. 3 and FIG. 4) of the head portion 18 to be adjacent thereto in a wiping direction A1 (an example of the movement direction of the present disclosure) of a wiper member 35 (see FIG. 10) that is described below. Here, the wiping direction A1 is a direction in which the wiper member 35 moves while in contact with the ink ejection surface F1 from a movement start position P1 (see FIG. 11) to a movement stop position P2 (see FIG. 13), when the ink ejection surface F1 is washed (see FIG. 11 to FIG. 13). It is noted that a configuration of the washing liquid supply portion 60 is described below.

Figure 5:
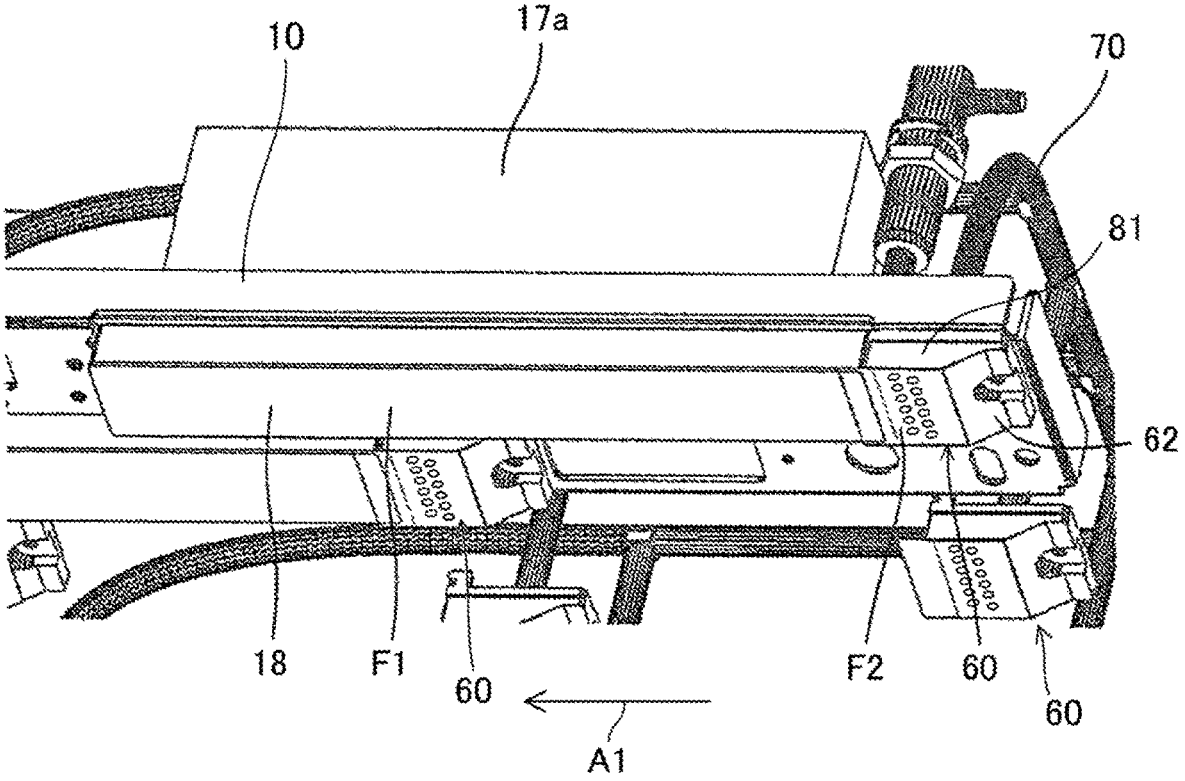
FIG. 5 is a diagram showing the recording head and its periphery viewed from diagonally below.
Figure 6:
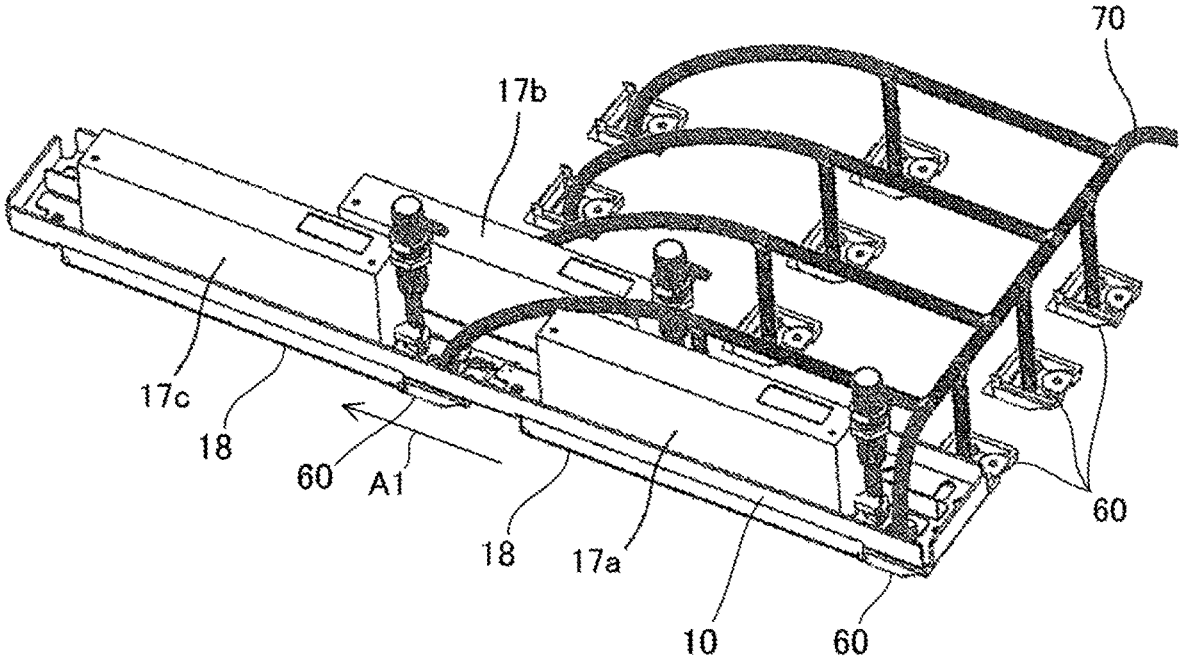
FIG. 6 is a diagram showing the recording head and its periphery viewed from diagonally above.

As shown in FIG. 3, FIG. 5, and FIG. 6, a tube 70 is connected to the washing liquid supply portions 60. It is noted that in FIG. 3, FIG. 5, and FIG. 6, to facilitate understanding, recording heads 17*a*, 17*b*, and 17*c* that are part of the whole recording heads 17*a*, 17*b*, and 17*c* are shown.

The tube 70 includes an inner space 701 in which the washing liquid moves. In addition, the tube 70 includes a plurality of branch portions. In the present embodiment, the tube 70 includes 12 branch portions, and the branch portions are connected to the washing liquid supply portions 60 of the recording heads 17*a*, 17*b*, and 17*c*. The tube 70 is connected to a washing liquid tank 71. The washing liquid tank 71 stores the washing liquid that is supplied to the washing liquid supply portions 60. In addition, the tube 70 is provided with the liquid feed pump 72 (see FIG. 3) and the open/close valve 73 (see FIG. 3). It is noted that as the washing liquid, a material whose main components are solvent and water may be used. In addition, a surface active agent, an antiseptic and antifungal agent, and/or the like may be added to the washing liquid as necessary.

The liquid feed pump 72 provides power for moving the washing liquid in the inner space 701 of the tube 70. As the liquid feed pump 72, a known pump may be used, but a positive displacement pump is preferable since it can supply a a fixed, small quantity of the washing liquid from washing liquid nozzles 63 (see FIG. 7). Usable positive displacement pumps include, for example, a syringe pump, a piston pump, a plunger pump, and a gear pump.

The open/close valve 73 is provided between the liquid feed pump 72 and the washing liquid supply portions 60. The open/close valve 73 switches between: an open state in which the inner space 701 of the tube 70 is opened; and a closed state in which the inner space 701 of the tube 70 is closed. As the open/close valve 73, any known valve may be used as far as opening and closing thereof can be controlled by the control portion 110.

Operation of the liquid feed pump 72 and the open/close valve 73 is controlled by the control portion 110. The control portion 110 controls operation of the liquid feed pump 72. Specifically, when supplying the washing liquid to the washing liquid supply portions 60, the control portion 110 controls the operation of the liquid feed pump 72 to a drive state where the washing liquid is moved in the inner space 701 of the tube 70. On the other hand, when not supplying the washing liquid to the washing liquid supply portions 60, the control portion 110 controls the operation of the liquid feed pump 72 to a drive stop state where the movement of the washing liquid in the inner space 701 of the tube 70 is stopped.

In addition, the control portion 110 controls the open/close valve 73 so as to cause the inner space 701 of the tube 70 to be in the open state or the closed state. Specifically, when the liquid feed pump 72 is in the drive state so that the washing liquid is supplied to the washing liquid supply portions 60, the control portion 110 controls the open/close valve 73 so as to cause the inner space 701 of the tube 70 to be in the open state. In addition, the control portion 110 controls the open/close valve 73 so as to cause the inner space 701 of the tube 70 to be in the closed state during a wiping time period in which the wiper member 35 performs wiping (see FIG. 10 to FIG. 14), in a drive stop period in which the liquid feed pump 72 is in the drive stop state and the liquid feed pump 72 does not supply the washing liquid to the washing liquid supply portions 60. On the other hand, the control portion 110 controls the open/close valve 73 so as to cause the inner space 701 of the tube 70 to be in the open state during a non-wiping time period in which the wiper member 35 does not perform the wiping, in the drive stop period.

In the inkjet recording apparatus 100, the control portion 110 controls the operation of the liquid feed pump 72 and the open/close valve 73 so that the washing liquid 23 (see FIG. 10) is supplied from the washing liquid nozzles 63 (see FIG. 7) of the washing liquid supply portions 60 to all of the recording heads 17*a*, 17*b*, and 17*c*. Subsequently, in the inkjet recording apparatus 100, the wiper member 35 wipes off the washing liquid 23 from the ink ejection surface F1, thereby washing the ink ejection region R1 (see FIG. 10 to FIG. 14). The timing at which the ink ejection region R1 is washed is, for example, when printing is to be started after the inkjet recording apparatus 100 is stopped for a long time period, or during a time period while a printing operation is not performed (between sheets, or between jobs).

Back to FIG. 1, a second conveyance unit 12 is disposed on a downstream side of the first conveyance unit 5 in the sheet conveyance direction X (at the right side in FIG. 1). The second conveyance unit 12 includes a second drive roller 13, a second driven roller 14, and a second conveyance belt 15 that is stretched over the second drive roller 13 and the second driven roller 14. When the second drive roller 13 is rotationally driven clockwise in FIG. 1, the second conveyance unit 12 conveys a paper sheet S held on the second conveyance belt 15 along the sheet conveyance direction X.

The paper sheet S on which an image has been recorded by the recording portion 9 by the ink, is conveyed toward the second conveyance unit 12. The ink on the surface of the paper sheet S dries while the paper sheet S passes through the second conveyance unit 12.

In addition, a pair of discharge rollers 16 for discharging the paper sheet S with the image recorded thereon to outside the apparatus, are provided on a downstream side of the second conveyance unit 12 in the sheet conveyance direction X. In addition, a discharge tray (not shown) on which paper sheets S discharged to outside the apparatus are stacked, is provided on a downstream side of the pair of discharge rollers 16.

A lifting/lowering mechanism 20 is disposed below the first conveyance unit 5. The lifting/lowering mechanism 20 supports the first conveyance unit 5 from below, and lifts and lowers the first conveyance unit 5 in an up/down direction below the line heads 11C, 11M, 11Y, and 11K. That is, the lifting/lowering mechanism 20 causes the first conveyance unit 5 and the line heads 11C, 11M, 11Y, and 11K to separate from each other and approach each other by causing the first conveyance unit 5 to move relative to the line heads 11C, 11M, 11Y, and 11K. Specifically, the lifting/lowering mechanism 20 causes the first conveyance unit 5 to move between a recording position (a position shown by a solid line in FIG. 1) and a maintenance position (a position shown by a dotted line in FIG. 1), wherein when the first conveyance unit 5 is at the recording position, the recording portion 9 can perform printing, and the maintenance position is a predetermined distance below the recording position.

The lifting/lowering mechanism 20 includes a lift plate 201, a link arm 202, and a main body portion 203, wherein the lift plate 201 supports the first conveyance unit 5, the link arm 202 is attached to the lift plate 201, and the main body portion 203 transmits power for moving the link arm 202 in the up/down direction. It is noted that the lifting/lowering mechanism 20 is not limited such a configuration, but may have any configuration as far as it can lift and lower the first conveyance unit 5.

A maintenance unit 19 and a cap unit 90 are disposed below the second conveyance unit 12.

The maintenance unit 19 performs the wiping operation in which to wash the ink ejection region R1 by wiping off the ink from the ink ejection surface F1. The maintenance unit 19 moves to below the recording portion 9 so as to perform the wiping operation. Specifically, a space is generated immediately below the line heads 11C, 11M, 11Y, and 11K when the lifting/lowering mechanism 20 moves the first conveyance unit 5 to the maintenance position. The maintenance unit 19 is horizontally moved by a horizontal movement mechanism (not shown) to the space. After the maintenance unit 19 is moved to below the line heads 11C, 11M, 11Y, and 11K, the first conveyance unit 5 is lifted by the lifting/lowering mechanism 20 from the maintenance position by a predetermined distance. This allows the maintenance unit 19 to be moved to directly below the recording portion 9.

The maintenance unit 19 includes a plurality of wiper members 35, a carriage (not shown), and a support frame (not shown), wherein the wiper members 35 (an example of the cleaning member of the present disclosure, see FIG. 10 to FIG. 14) are configured to move along the ink ejection surfaces F1, the support frame is configured to support the carriage, and the carriage is supported so as to slide with respect to the support frame in the sheet width direction A (see FIG. 2).

The wiper members 35 are formed from an elastic material such as rubber (for example, EPDM rubber) for applying and wiping the washing liquid 23 supplied from the washing liquid nozzles 63 of the washing liquid supply portions 60 of the recording heads 17*a*, 17*b*, and 17*c* (see FIG. 7 and FIG. 10), to/from the ink ejection surfaces F1. Each of the wiper members 35 is pressed against an inclined surface 62 that is provided on an upstream side of a washing liquid supply region R2 of the washing liquid supply portion 60 in the wiping direction A1, then moved along a washing liquid supply surface F2 and the ink ejection surface F1 as the carriage moves, and moved along the ink ejection surface F1 in a state of being in close contact with the ink ejection surface F1. This allows the wiper member 35 to clean the ink ejection surface F1.

In addition, the maintenance unit 19 applies and wipes the washing liquid 23 supplied from the washing liquid nozzles 63 of the washing liquid supply portions 60 (see FIG. 7 and FIG. 10), to/from the ink ejection surfaces F1, and collects the wiped washing liquid. The collected washing liquid is reserved in an ink tray (not shown) provided in the carriage, and then sent to a waste ink tank (not shown).

The cap unit 90 horizontally moves to below the recording portion 9 so as to perform capping of the ink ejection surfaces F1 of the recording heads 17*a*, 17*b*, and 17*c*. Subsequently, the cap unit 90 moves upward from below and covers the lower surfaces of the recording heads 17*a*, 17*b*, and 17*c*.

Figure 7:
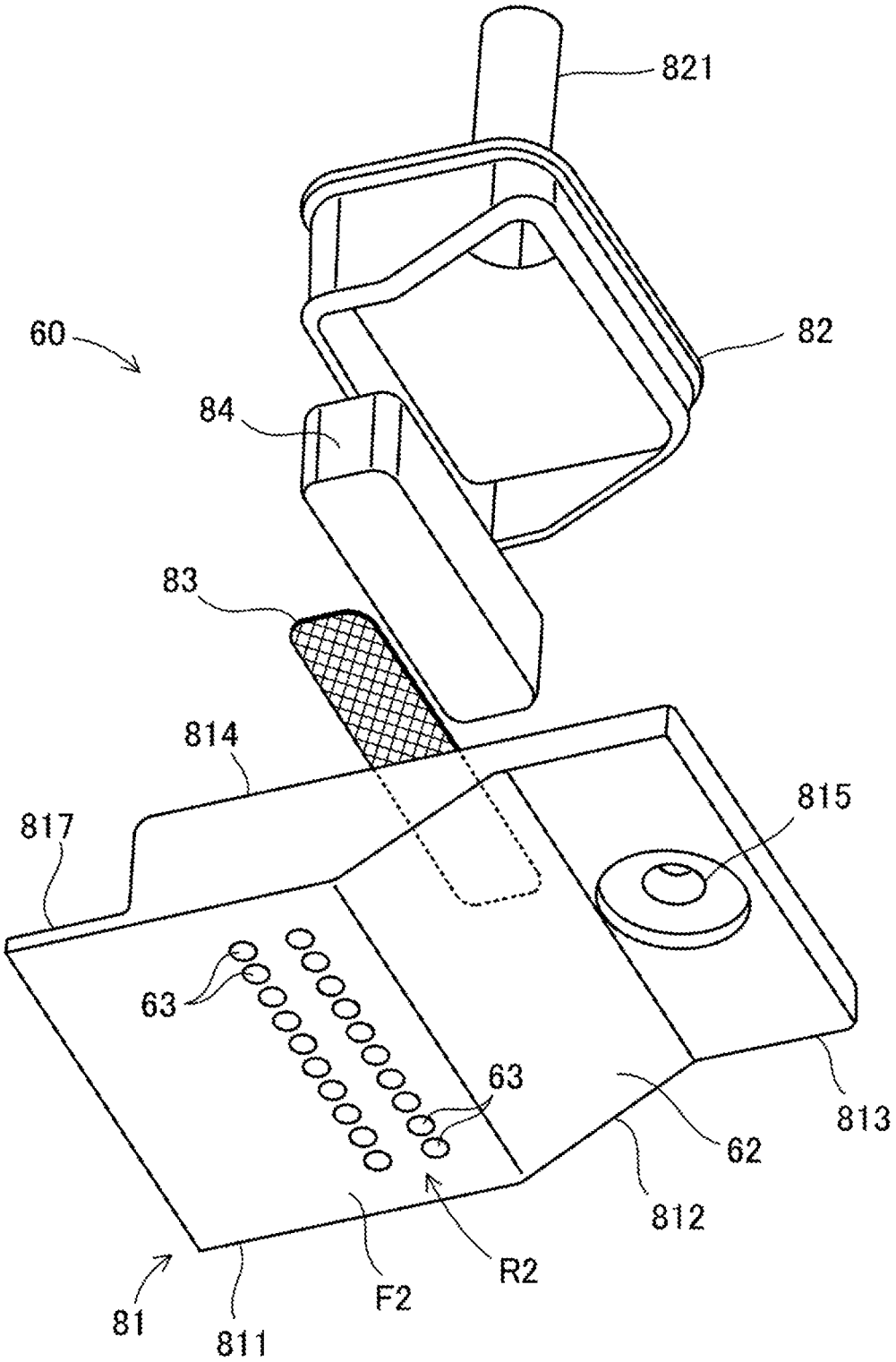
FIG. 7 is a broken perspective diagram of a washing liquid supply portion.
Figure 8:
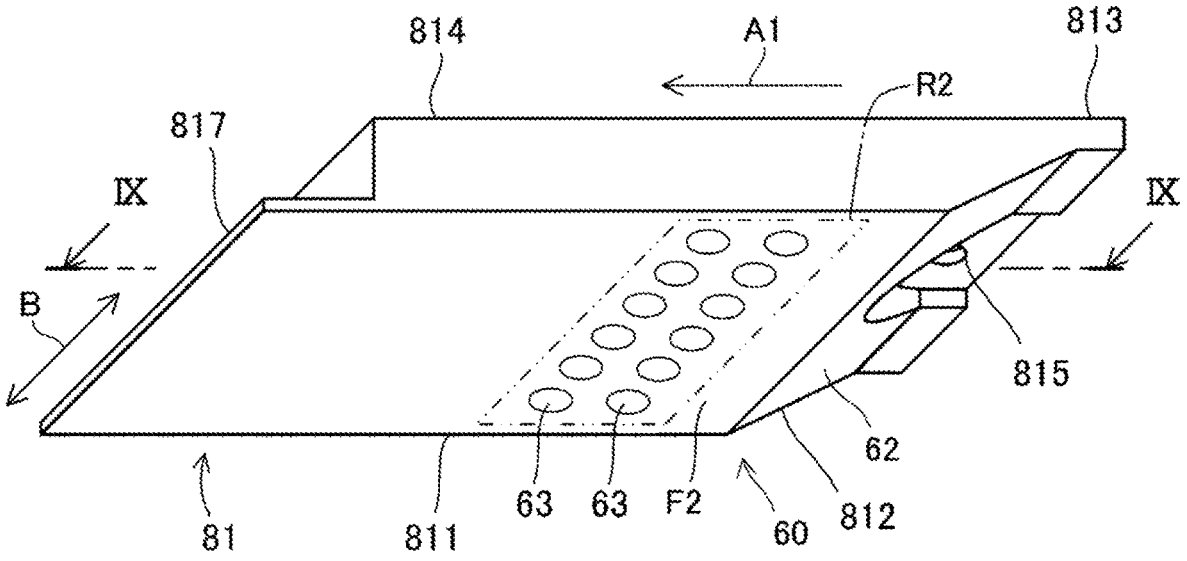
FIG. 8 is a diagram of the washing liquid supply portion viewed from diagonally below.
Figure 9:
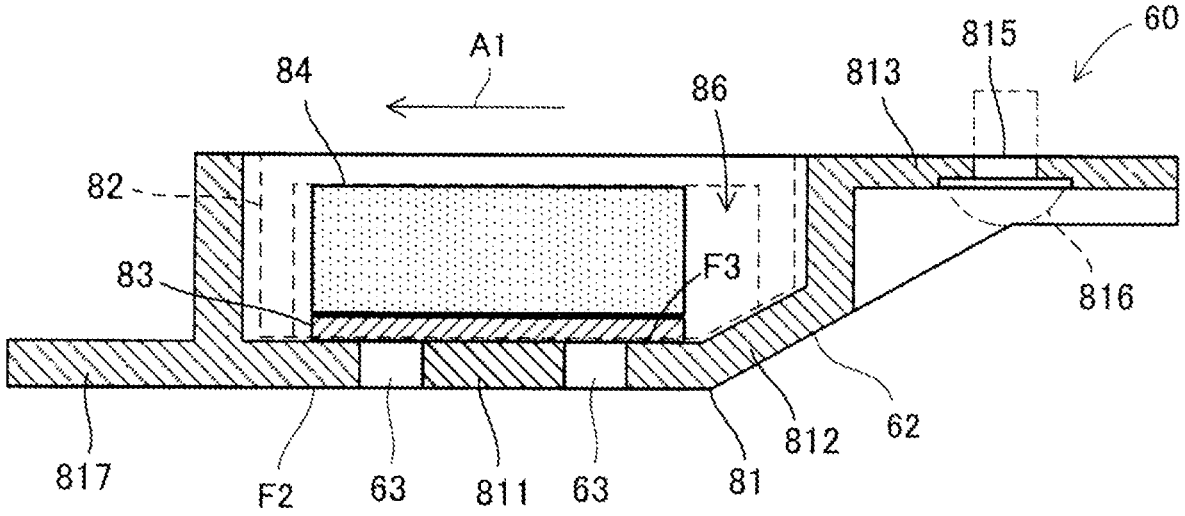
FIG. 9 is a cross-sectional diagram taken along an IX-IX cut line shown in FIG. 8.

The following describes a configuration of the washing liquid supply portions 60 with reference to FIG. 7 to FIG. 9. As described above, the washing liquid supply portions 60 are disposed on the upstream side (the right side in FIG. 3 and FIG. 4) of the head portions 18 to be adjacent thereto in the wiping direction A1. Each of the washing liquid supply portion 60 includes the washing liquid supply surface F2 that includes the washing liquid supply region R2 in which a plurality of the washing liquid nozzles 63 (see FIG. 7) for supplying the washing liquid are aligned in columns. In addition, the washing liquid supply surface F2, together with the ink ejection surface F1, constitutes the wiping surface. It is noted that the wiping surface comes in contact with the wiper member 35 when the wiper member 35 moves to wash the ink ejection surface F1.

As shown in FIG. 7 to FIG. 9, each of the washing liquid supply portions 60 includes a base body 81 (an example of the washing liquid storage portion of the present disclosure), an inner case 82, a mesh sheet 83, and a sponge member 84. It is noted that in FIG. 9, the inner case 82 is represented by a dotted line.

The base body 81 includes a flat portion 811, an inclined portion 812, and a horizontal end portion 813 that are integrally formed, wherein the flat portion 811 includes the washing liquid supply surface F2, and the inclined portion 812 includes the inclined surface 62. As a result, the surface of the base body 81 continues from the washing liquid supply surface F2 of the flat portion 811 to the inclined surface 62 of the inclined portion 812. The base body 81 is hollow inside, and an upper surface 814 of the base body 81 (see FIG. 8) has an opening for opening the hollow upward. The inner case 82 is stored in the inside of the base body 81. The inner case 82 has a shape corresponding to the shapes of the flat portion 811 and the inclined portion 812, and is formed in the shape of a box whose lower surface has an opening. With the configuration where the inner case 82 is stored in the inside of the base body 81, a storage space 86 (see FIG. 9) sealed by the base body 81 and the inner case 82 is formed. The washing liquid is stored in the storage space 86. That is, the base body 81 is a storage portion that stores both the inner case 82 and the washing liquid for washing the ink ejection surface F1. A joint 821 having a through hole therein is provided on an upper surface of the inner case 82, and the tube 70 is attached to the joint 821. This allows the washing liquid to be supplied to the inside of the storage space 86 via the tube 70.

In addition, in the inclined portion 812, a through hole 815 is formed between the inclined portion 812 and the horizontal end portion 813. The through hole 815 is used when the base body 81 is fixed to the head frame 10 by a fixing member 816 such as a screw.

The plurality of washing liquid nozzles 63 are formed in the flat portion 811 of the base body 81. Each of the washing liquid nozzles 63 includes a communicating hole that is communicated from the washing liquid supply surface F2 of the flat portion 811 to the storage space 86 in the inside of the base body 81. A concave meniscus is formed on the surface of the washing liquid in the communicating hole. In other words, each of the washing liquid nozzles 63 forms the concave meniscus of the washing liquid by the capillary force of the washing liquid that acts on the inside of the washing liquid nozzle 63. It is noted that a lower opening of the washing liquid nozzle 63 that appears on the washing liquid supply surface F2 is a supply port through which the washing liquid is supplied to the washing liquid supply region R2.

The base body 81 is formed from synthetic resin. To form the concave meniscus in each of the washing liquid nozzles 63, the inner diameter of the washing liquid nozzle 63 is preferably small. However, with regard to the base body 81 that is formed from synthetic resin, due to the difficulty in forming the washing liquid nozzle 63, the inner diameter of the washing liquid nozzle 63 is set to approximately 0.5 mm. That is, in the base body 81 formed from synthetic resin, when the inner diameter of the washing liquid nozzle 63 is less than 0.5 mm, processing the washing liquid nozzle 63 becomes difficult.

In addition, a projecting portion 817 is provided on the base body 81, the projecting portion 817 projecting from a side end portion (the left end portion in FIG. 9) of the flat portion 811 to a downstream side thereof in the wiping direction A1. The projecting portion 817 is a thin, eaves-like member projecting toward the adjacent ink ejection surface F1 in such a way as to cover the ink ejection surface F1. That is, the projecting portion 817 covers a region between the recording portion 9 and the flat portion 811 of the base body 81.

Meanwhile, in a configuration having the washing liquid nozzles 63, when the liquid surface of washing liquid stored in the washing liquid tank 71 is varied, the meniscus of the washing liquid in each of the washing liquid nozzles 63 cannot be stabilized. For example, when the liquid surface in the washing liquid tank 71 is high, a positive pressure is applied to the washing liquid in the washing liquid nozzle 63, and the meniscus of the washing liquid in the washing liquid nozzle 63 collapses. This may lead to various problems. For example, the washing liquid may project from the washing liquid nozzle 63 when an image is recorded on the paper sheet S, or the washing liquid may be ejected and adhere to the paper sheet S. Conversely, when the liquid surface in the washing liquid tank 71 is low, it may be difficult to supply a sufficient amount of washing liquid to wash the ink ejection surface F1 to the ink ejection surface F1. To stabilize the meniscus in each washing liquid nozzle 63, an individual mechanism for stabilizing the liquid surface of the washing liquid tank 71 might be provided. However, that will complicate the configuration of the inkjet recording apparatus 100. In view of such problems, the present embodiment has a simple configuration where the mesh sheet 83 and the sponge member 84 are provided in the storage space 86 to realize the stabilization of the meniscus of the washing liquid and supply of a constant amount of washing liquid.

The mesh sheet 83 made of a metal is provided in the storage space 86. The mesh sheet 83 is formed such that a so-called scale division opening which indicates the size of the openings, is smaller than the inner diameter of the washing liquid nozzle 63. For example, the mesh sheet 83 is a twilled weave wire mesh woven by a stainless steel wire whose wire diameter is 0.02 mm, the mesh of the mesh sheet 83 being 635 mesh. In this case, the scale division opening of the mesh sheet 83 is 0.02 mm, and the space ratio is 25%. It is noted that the scale division opening of the mesh sheet 83 is not limited to 0.02 mm, but may be any size as far as it is smaller than the inner diameter of the washing liquid nozzle 63. In the present embodiment, as shown in FIG. 9, the mesh sheet 83 is provided in close contact with a rear surface F3 of the flat portion 811 (see FIG. 9), the rear surface F3 being an inner surface of the flat portion 811 opposite to the washing liquid supply surface F2. With such a configuration of the mesh sheet 83, a negative pressure is applied to the inside of the washing liquid nozzle 63 by the capillary force of the mesh sheet 83. As a result, a concave meniscus is suitably formed in each of the washing liquid nozzles 63.

It is noted that although in the present embodiment, a piece of mesh sheet 83 is provided in the storage space 86, a plurality of pieces of mesh sheets 83 may be provided.

In addition, the sponge member 84 is provided in the storage space 86. The sponge member 84 is an example of a porous member, and includes a multiple number of inner holes that are each larger than the scale division opening of the mesh sheet 83 and smaller than the inner diameter of the washing liquid nozzle 63. With such a configuration, the sponge member 84 can absorb and hold the washing liquid, and apply a negative pressure to the inside of the washing liquid nozzle 63 via the mesh sheet 83 by the capillary force. The sponge member 84 is provided in a compressed state on the mesh sheet 83 in the storage space 86. As a result, the mesh sheet 83 is pressed toward the rear surface F3 of the flat portion 811 (see FIG. 9) by the restoring force of the sponge member 84. This allows the mesh sheet 83 to be in close contact with the rear surface F3 of the flat portion 811 without using a fixing means such as an adhesive.

The following describes, with reference to FIG. 10 to FIG. 14, a recovery operation of recording heads 17*a*, 17*b*, and 17*c* performed in the inkjet recording apparatus 100 according to the present embodiment by using the maintenance unit 19. It is noted that the recovery operation of the recording heads 17*a*, 17*b*, and 17*c* described in the following is executed by controlling operations of the recording heads 17*a*, 17*b*, and 17*c*, the maintenance unit 19 and the like based on a control signal from the control portion 110 (see FIG. 1).

In the recovery operation of the recording heads 17*a*, 17*b*, and 17*c*, first, the control portion 110 (see FIG. 1) lowers the first conveyance unit 5 that is located below the recording portion 9, by controlling the drive of the lifting/lowering mechanism 20. Subsequently, the control portion 110 moves in the horizontal direction the maintenance unit 19 that is disposed below the second conveyance unit 12, to a position between the recording portion 9 and the first conveyance unit 5. In this state, the wiper members 35 of the maintenance unit 19 are positioned lower than the ink ejection surfaces F1 and the washing liquid supply surfaces F2 of the recording heads 17*a*, 17*b*, and 17*c* (see FIG. 10). At this time, the liquid feed pump 72 is controlled to be in the drive stop state by the control portion 110, and the open/close valve 73 is controlled by the control portion 110 so that the inner space 701 of the tube 70 is in the open state.

[Washing Liquid Supply Operation]

Figure 10:
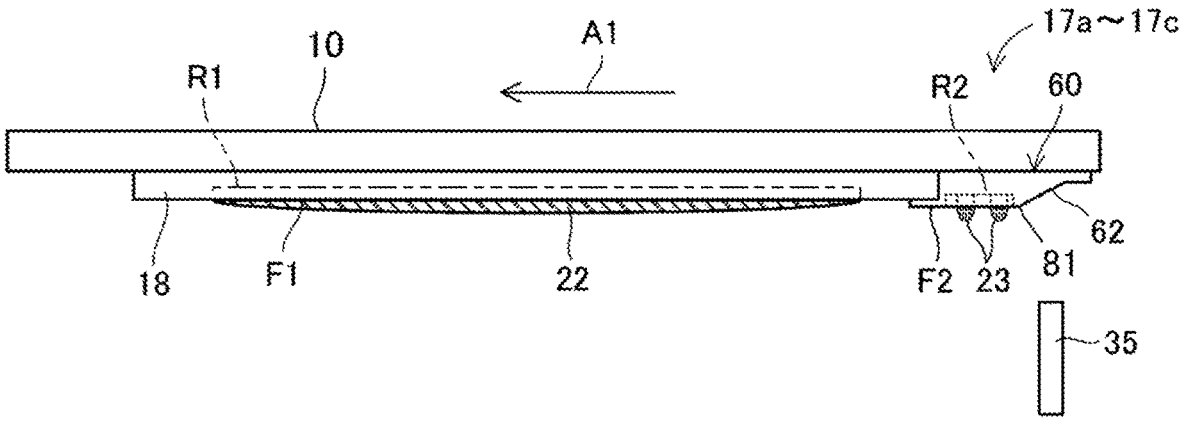
FIG. 10 is a diagram showing a state where a wiper member is disposed below the recording head.

As shown in FIG. 10, the control portion 110 controls the liquid feed pump 72 to the drive state prior to a wiping operation that is described below, so that the washing liquid 23 is supplied to the washing liquid supply portions 60. From each of the washing liquid supply portions 60, a predetermined amount of washing liquid 23 is supplied to the washing liquid supply region R2 via the washing liquid nozzles 63. It is noted that except for a time period in which the wiping operation is executed, the inner space 701 of the tube 70 is maintained to be in the open state by the open/close valve 73 controlled by the control portion 110 even while the washing liquid supply operation is executed. As a result, the washing liquid 23 is supplied to the washing liquid supply portions 60 when the control portion 110 controls the liquid feed pump 72 to be in the drive state, without controlling the open/close valve 73 to the open state. In addition, when a predetermined amount of washing liquid has been supplied to the washing liquid supply region R2, the control portion 110 controls the liquid feed pump 72 to the drive stop state such that the supply of the washing liquid 23 to the washing liquid supply portions 60 is stopped.

[Purge Operation]

In addition, prior to the wiping operation that is described below, the control portion 110 supplies ink 22 to the recording heads 17*a*, 17*b*, and 17*c*. The supplied ink 22 is forcibly purged from the ink ejection nozzles 18*a*. With this purge operation, viscous ink, foreign substances, bubbles and the like are discharged from the ink ejection nozzles 18*a*. At this time, the purged ink 22 is ejected onto the ink ejection surface F1 along the shapes of the ink ejection regions R1 that are present in the ink ejection nozzles 18*a*.

[Wiping Operation]

Figure 11:
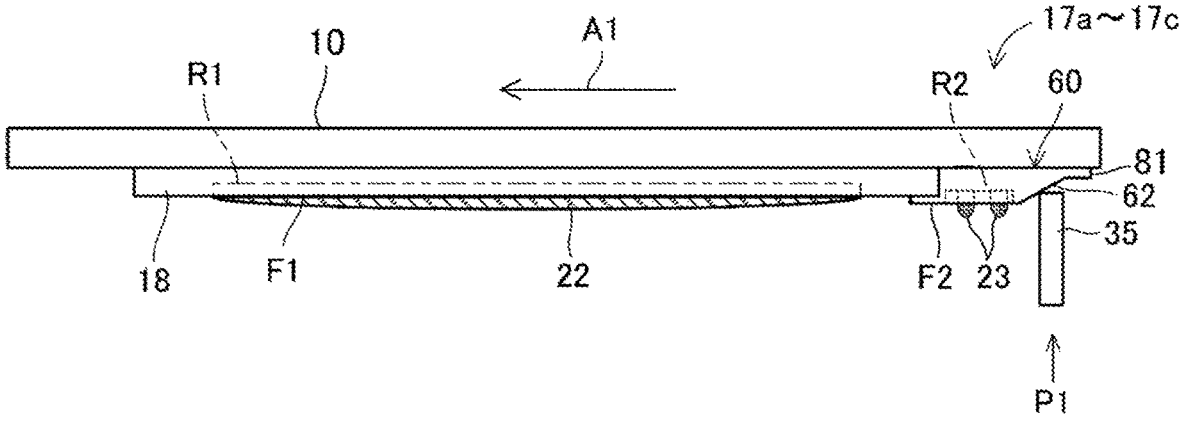
FIG. 11 is a diagram showing a state where the wiper member has been lifted from the state shown in FIG. 10 and pressed in contact with the washing liquid supply portion.

As shown in FIG. 11, the control portion 110 lifts the wiper members 35 and causes them to contact, with a predetermined pressure, the inclined surfaces 62 of the washing liquid supply portions 60 of the recording heads 17*a*, 17*b*, and 17*c*. The position at which each of the wiper members 35 is present immediately prior to moving in the wiping direction A1 upon contact with the inclined surface 62, is the movement start position P1 of the wiper member 35 during the wiping operation. That is, the movement start position P1 is a position at which an upper end of the wiper member 35 comes in contact with the inclined surface 62. In addition, the control portion 110 controls the open/close valve 73 so as to cause the inner space 701 of the tube 70 to be in the closed state for a time period from when the liquid feed pump 72 is made to be in the drive stop state and the supply of the predetermined amount of washing liquid to the washing liquid supply region R2 ends, to when the wiper members 35 starts to move in the wiping direction A1.

Figure 12:
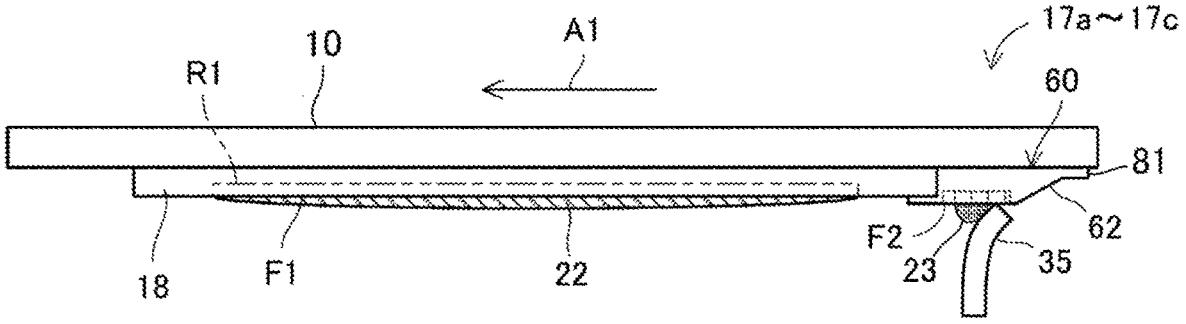
FIG. 12 is a diagram showing a state where the wiper member has been moved in a wiping direction from the state shown in FIG. 11.

As shown in FIG. 12, when the tip of the wiper member 35 is pressed against the inclined surface 62 of the washing liquid supply portion 60, the control portion 110 starts moving the wiper member 35 along the washing liquid supply surface F2 toward the ink ejection region R1 in the wiping direction A1. At this time, the liquid feed pump 72 is maintained to be in the drive stop state by the control portion 110, and the open/close valve 73 is controlled by the control portion 110 such that the inner space 701 of the tube 70 is in the closed state.

Figure 13:
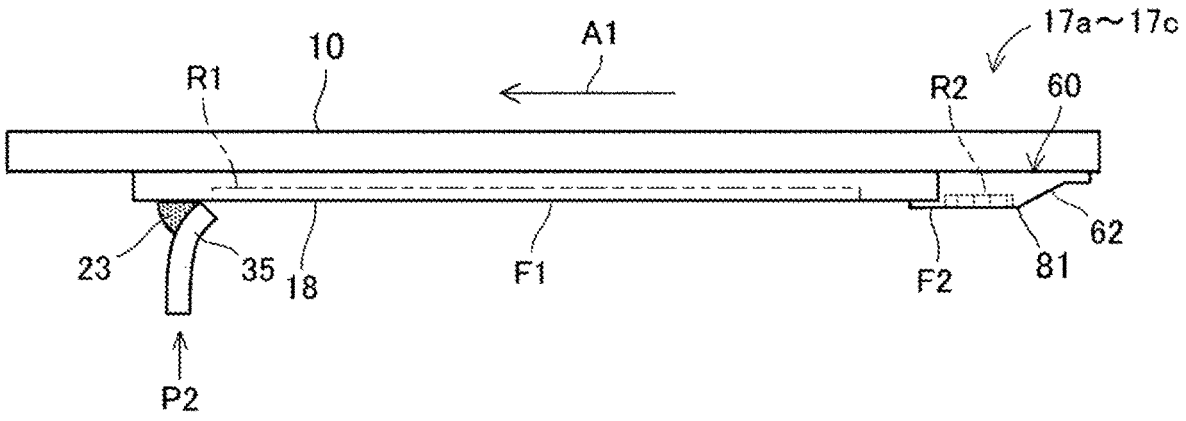
FIG. 13 is a diagram showing a state where the wiper member has been further moved in the wiping direction from the state shown in FIG. 12.

As shown in FIG. 13, the wiper member 35 moves along the ink ejection surface F1 in the wiping direction A1 while holding the washing liquid 23. At this time, the washing liquid 23 and the purged ink 22 (see FIG. 11) dissolve the ink drops (waste ink) that have adhered to the ink ejection surface F1 and solidified, and the dissolved ink drops are wiped off by the wiper member 35. The wiper member 35 further moves in the wiping direction A1 and stops moving in the wiping direction A1 after reaching the movement stop position P2 that is opposite to the washing liquid supply region R2 with respect to the ink ejection region R1. It is noted that the washing liquid 23, the waste ink, and the purged ink 22 wiped off by the wiper member 35 are collected into an ink tray (not shown) provided in the maintenance unit 19.

[Separating Operation]

Figure 14:
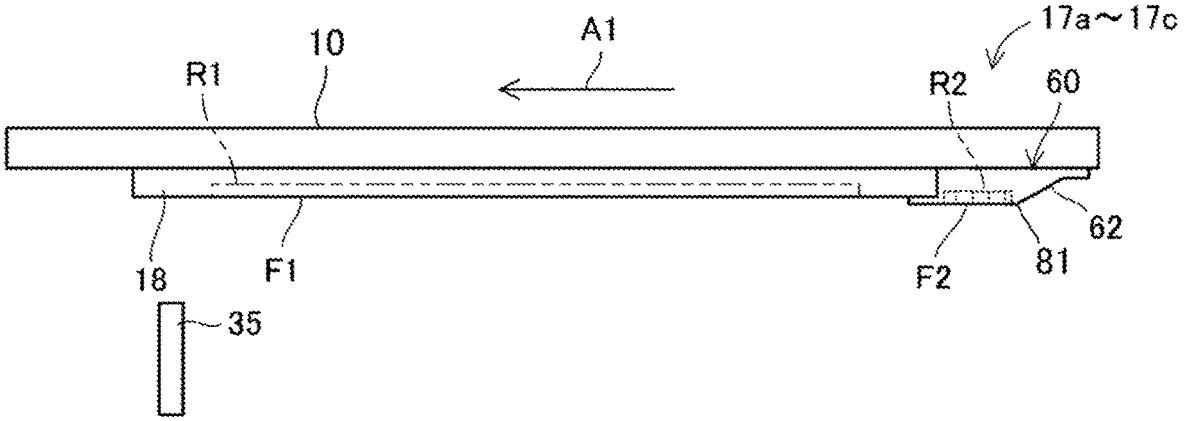
FIG. 14 is a diagram showing a state where the wiper member has been lowered from the state shown in FIG. 13.

As shown in FIG. 14, after the execution of the wiping operation, the control portion 110 lowers the wiper member 35 so as to be separated from the ink ejection surface F1. In addition, after the execution of the wiping operation, the control portion 110 controls the open/close valve 73 so that the inner space 701 of the tube 70 is in the open state. At this time, the control portion 110 maintains the drive stop state of the liquid feed pump 72.

Lastly, the control portion 110 horizontally moves the maintenance unit 19 from between the recording portion 9 and the first conveyance unit 5 to below the second conveyance unit 12, and lifts the first conveyance unit 5 to a predetermined position. This completes the recovery operation of the recording heads 17*a*, 17*b*, and 17*c*.

In the present embodiment, a plurality of washing liquid nozzles 63 for supplying the washing liquid 23 are provided on the upstream side of the ink ejection region R1 in the wiping direction A1. With this configuration, after the washing liquid 23 is supplied from the washing liquid nozzles 63, the wiper members 35 are moved from a position located on the upstream side of the ink ejection region R1 in the wiping direction A1, along the ink ejection surface F1. This allows the wiper members 35 to wipe the ink ejection surfaces F1 while holding the washing liquid 23. In this way, it is possible to clean the ink ejection surface F1.

It is noted that in the above-described embodiment, the washing liquid supply portions 60 including the washing liquid supply regions R2 are provided independently of the head portions 18. However, the present disclosure is not limited to this configuration. For example, the washing liquid supply portions 60 may be omitted, and the washing liquid nozzles 63 may be provided in the head portions 18.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An inkjet recording apparatus comprising:

an ink ejection surface including an ink ejection port from which ink is ejected;

a washing liquid storage portion including a supply surface adjacent to the ink ejection surface, and storing washing liquid used for washing the ink ejection surface;

a washing liquid nozzle including a communicating hole that is communicated from a supply port formed in the supply surface of the washing liquid storage portion to an inside of the washing liquid storage portion, and configured to form a concave meniscus by a surface of the washing liquid in the communicating hole;

a metal-made mesh sheet provided in close contact with an opposite rear surface of the supply surface of the washing liquid storage portion, the mesh sheet having an opening that is smaller in size than an inner diameter of the communicating hole; and a sponge member provided in a compressed state in the inside of the washing liquid storage portion and configured to absorb and hold the washing liquid and press the mesh sheet toward the opposite rear surface of the supply surface so that the mesh sheet comes in close contact with the opposite rear surface of the supply surface.

2. The inkjet recording apparatus according to claim 1, further comprising:

a recording head including the ink ejection surface;

a cleaning member configured to wash the ink ejection surface by the washing liquid by moving while in contact with the ink ejection surface; and an inclined surface provided continuing from the supply surface, on an upstream side of the supply surface in a movement direction of the cleaning member, the inclined surface being inclined upward with respect to the supply surface, wherein when the cleaning member is to start moving in the movement direction, the cleaning member is disposed to a movement start position at which a tip of the cleaning member comes in contact with the inclined surface.

3. The inkjet recording apparatus according to claim 2, wherein the washing liquid storage portion is disposed on an upstream side of the recording head in the movement direction in alignment.

4. The inkjet recording apparatus according to claim 1, wherein the sponge member includes a plurality of inner holes that are each larger than the opening of the mesh sheet.

* * * * *